US005956917A

United States Patent [19]

Reynolds

[11] Patent Number: 5,956,917

[45] Date of Patent: Sep. 28, 1999

[54] CO-AXIAL JOINT SYSTEM

[76] Inventor: Glenn A. Reynolds, 2038 Rutgers Ave., Long Beach, Calif. 90815

[21] Appl. No.: 09/005,282

[22] Filed: Jan. 9, 1998

Related U.S. Application Data

[60] Provisional application No. 60/035,242, Jan. 9, 1997.

[51] Int. Cl.[6] ..... E04H 12/10

[52] U.S. Cl. ..... 52/655.1; 52/81.3; 52/653.2; 52/655.2; 403/174; 403/217; 403/299

[58] Field of Search ..... 52/81.3, 646, 653.2, 52/655.1, 655.2; 403/170, 174, 178, 217, 218, 299, 362

[56] References Cited

U.S. PATENT DOCUMENTS

| | | | |
|---|---|---|---|
| 3,789,562 | 2/1974 | De Chicchis et al. | 52/655.2 |
| 3,882,650 | 5/1975 | Gugliotta | 52/655.2 X |
| 4,692,054 | 9/1987 | Kirby | 52/655.1 X |
| 5,051,019 | 9/1991 | Kohl | 52/81.3 X |
| 5,632,129 | 5/1997 | Imai et al. | 52/655.1 |

OTHER PUBLICATIONS

Kawaguchi, "Possibilities and problems of Latticed Structures," Spatial/Lattice and Tension Structures: Proceeding of the IASS–ASCE Int'l Symposium 1994, UCLA Science & Engineering Library, TA 660 S63S63, 1994, pp. 350–376.

Z.S. Makowski, Chapter 1, "Space structures, A short review of their development," Space Structures, Blackwell Scientific Publications, pp. 1–8, Sep., 1996.

P. Bueno & J. Calavera, Chapter 51, "Flat roofs made of tubular space structures," Space Structures, Blackwell Scientific Publications, pp. 581–595, Sep., 1996.

P.M. Lovie, Chapter 53, "The design and full scale testing of a geodetic transmission tower," Space Structures, Blackwell Scientific Publications, pp. 605–621, Sep., 1996.

H.G. Fentiman, Chapter 93, "Developments in Canada in the fabrication and construction of three–dimensional structures using the triodetic system," Space Structures, Blackwell Scientific Publications, pp. 1073–1082, Sep., 1996.

Max Mengeringhausen, Chapter 99, Kompositionslehre räumlicher Stab–Fachwerke, Space Structures, Blackwell Scientific Publications, pp. 1109–1120, Sep., 1996.

Hanaor, Ariel, "Design and Behaviour of Retriculated Spatial Structural Systems," International Journal of Space Structures, vol. 10 No. 3 1995, pp. 139–149.

Hanaor, Ariel, "Characteristics of Prefabricated Spatial Frame Systems, " International Journal of Space Structures vol. 10 No. 3 1995, pp. 151–173.

Hanaor, Ariel, "A Summary Survey of Prefabricated Spatial Frame Systems" International Journal of Space Structures vol. 10 No. 3 1995, pp. 175–188.

*Primary Examiner*—Christopher T. Kent
*Attorney, Agent, or Firm*—Christie, Parker & Hale, LLP

[57] ABSTRACT

The present invention is directed toward a novel moment resisting connection system, the Co-Axial Joint (CAJ) System, and a method of assembling the moment resisting connection system for use in diverse areas of architectural design, fabrication, engineering, and field erection of lattice structures. A given CAJ System connection is comprised of a framing member, a block connector, an end cap, an end cap-block connector attachment means, and a sleeve. The end cap, movably attached to the block connector, is connected to both the sleeve and framing member. To assemble the CAJ System, a sleeve is slid onto a framing member and positioned at the end of the member. The framing member is then positioned relative to the block connector. Attached to the block connector is an end cap which is made to align with the framing member. The end cap-block connector attachment means, typically a bolt, acts to absorb the tensile forces exerted on to the system without compromising the member-block connector connection. Once aligned, the end cap is shifted upwards and connected to the end of the frame member. The sleeve is then slid over the end cap, toward the block connector, and attached to the end cap in a position in which the sleeve acts to absorb compression forces exerted on to the framing member and to transfer such forces to the block connector without compromising the member-block connector connection.

27 Claims, 8 Drawing Sheets

15A
40A
52
40A
82
34A
82
44A
42A
19A
50A
36A
54
24A
30A
80
36A
18A
38A
28A
14A

CO-AXIAL JOINT SYSTEM

CROSS REFERENCE TO RELATED APPLICATION

This application claims priority of provisional patent Application No. 60/035,242 filed on Jan. 9, 1997.

FIELD OF THE INVENTION

The present invention relates to a non-welded, structural connection system with moment resisting capability for use in all areas of architectural design, engineering, fabrication, and field erection of reticulated structures using round, tubular members.

BACKGROUND OF THE INVENTION

Generally, reticulated structures are made of a network of two fundamental structural elements, nodes and interconnecting linear members. When the linear members consist of cylindrical tubes, connections to the nodes are generally pinned due to the configuration of connection mechanisms. Systems utilizing interlinked networks of pinned connections are commonly employed in the design, engineering, fabrication, and erection of numerous reticulated structures, including, but not limited to, domes, building facades, towers, stadium covers, bridges, and various applications of trusses.

In general, a typical pinned connection system employs a generally spherical node connected to a plurality of tubular framing members. The node has openings to receive parts, such as bolts, of connection assemblies, and the ends of tubular framing members are welded to other parts, such as an end cone, of the connection assemblies. The ends of the tubular framing members may be tapered to simplify or enhance the connection. By connecting each spherical node to a plurality of tubular framing members with connection assemblies, extensive networks of nodes and framing members may be interlinked to form a variety of reticulated structures. Many variations of this common "tube and ball node system" employ nodes attached to flat-faced connection assemblies to which tubular framing members are directly welded.

One specific type of tube and ball node system uses a spherical node with a plurality of rounded openings through which a bolt or pin is inserted and fixed therein. A funnel-shaped sleeve having a hollow cylindrical base is positioned between the spherical node and a hollow cylindrical framing member. The end of the framing member is properly swaged to conform to the funnel shape of the sleeve top. The swaged end of the framing member and the sleeve top are welded together, and a bolt is inserted through the framing member, extending through the sleeve base, and fixably attached, by threading to the node. An externally accessible collar, which is rotationally fixed to the bolt is provided to tighten the bolt. In this manner, the framing members are each individually attached to the spherical nodes and the reticulated structure is formed. In these configurations, shear, tensile, and compressive stresses are borne by the bolts. In some cases, the collar bears the compressive stresses. Generally, the bolts react well in tension but shear and compression can be problematic.

An interlinked network of pinned connection systems can be employed in a variety of ways in reticulated structures. These uses range from primarily acting as a load bearing structure to being an aesthetic addition to a building facade. The structural purpose of the network guides the determination of what compression and tensile forces will act upon the system. The network is designed to withstand the calculated magnitude and direction of compression and tensile forces. The effective design of such networks requires the development of an appropriate model of the system of pinned connections being employed in the structural design. Preferably, the model should be as simple as possible without compromising engineering accuracy. Furthermore, when employing cylindrical framing members, the connection system being used should strive to optimize the compression bearing characteristics common to cylindrical tubes.

Typical tube and ball node systems have some deficiencies that become apparent in the design, fabrication, and field erection of reticulated structures. Each member-node connection point within a standard tube and ball node system usually is modeled as a three part system comprised of a hinge at the node, a short flexible member representing the bolt and lastly the tube. Because the framing member often tapers into and is welded to a funnel-shaped sleeve which then connects into the node, a three part model is required to measure, with sufficient accuracy, the existence of a moment at the member-node connection point. The three part model obtains the accuracy necessary through the incorporation of a short flexible member and hinge. This three part model is problematic because of the complexity it introduces into reticulated structure designs.

To utilize simpler models would require the structure to have a substantial moment resisting capability at the point of connection between framing members and nodes, so that the short flexible member representing the bolt and/or collar with hinge could be deleted. Tube and ball node systems, however, fail to sufficiently resist moments at this connection because current designs require framing members to taper into a sleeve, collar and bolt. The reduction in the cross-sectional area of framing members at the connection introduces into the design an additional structural element, modeled as a hinge, and typically prevents moment transfer at the point of connection. Thus, under load, the pinned connection rotates slightly. As might the short flexible member without moment transfer. This also inhibits the application of loads to the framing members, and therefore, loud speakers, light assemblies, and other equipment must be attached to the nodes. Furthermore, when dealing with a cylindrical member, a reduction in cross-section at the connection diminishes its compression bearing characteristics.

To be practically employed in structural design, elements of a connection system should be relatively easy to manufacture. In tube and ball node systems, spherical nodes are difficult to manufacture and are often limited in size. Tube and ball node systems also have limitations in the type of material which can be used. Although polymers, plastics, aluminum, and a variety of composites may have the requisite strength, cost, and aesthetic design characteristics to be desirable for use in a reticulated structure, such materials are often sensitive to welding. The use of welding in the fabrication of a reticulated structure is costly and time consuming. It requires quality control measures, uses raw materials, and requires skilled workers. The use of welding in tube and ball node systems decreases the allowable stresses certain materials can bear and eliminates them from consideration for particular applications.

Finally, because of the intricate nature of many reticulated structures, field erection and assembly can be both difficult and costly. The erection of these structures is a rigid unforgiving process, and, often, the erection of a reticulated structure progresses to the point where two nodes, which are not yet connected by a framing member, are sufficiently fixed in place by a prior series of assembled connections such that connecting a framing member between the two fixed nodes requires forcibly moving the nodes apart to connect the tube. This is time consuming and can damage the structure.

Thus, it is desirable to have a connection system which can be simply modeled as an elongated member fixably attached to a nodal point, without having to incorporate a hinge and/or short flexible member to account for the transfer of forces at the point of connection. It is also desirable to develop a connection system that enables a cylindrical member to be used without significantly reducing its cross sectional area at the point of connection. Furthermore, it is desirable to have a connection system which does not require welding to attach framing members to nodes and provides a built-in clearance between the nodes to facilitate the insertion of framing members between two fixed points. It is also desirable to have a connection system design where the elements of the system are easier to fabricate, have a more flexible range in available material types, and are not limited in shape. It is further desirable to avoid loading bolts with shear and compressive stress.

SUMMARY OF THE INVENTION

There is, therefore, provided in the practice of this invention a Co-Axial Joint (CAJ) System and a method of assembling the CAJ System.

A given CAJ System moment resisting connection is comprised of a framing member, a block connector, a compression sleeve, an end cap attachable to the framing member and compression sleeve, and an end cap-block connector attachment means. A preferred embodiment of the CAJ System moment resisting connection employs a cylindrically-shaped framing member, complimentary buttress threads to attach the end cap to the compression sleeve and to the framing member, and a tension bolt to secure the end cap to the block connector. The block connector and tension bolt are hollow in one embodiment to receive electrical cables and the like.

Reticulated structures may be wholly or partially constructed using CAJ System moment resisting connections. Such a structure is comprised of a plurality of framing members, block connectors, compression sleeves, end caps, and end cap-block connector attachment means.

To assemble the CAJ System, a compression sleeve slides onto a framing member and is positioned near the end of the member. The framing member is then positioned relative to the block connector. An end cap, which is movably attached to the block connector, and the framing member are brought into alignment. Once aligned, the end cap is shifted towards and attached to the end of the framing member. The sleeve is then slid over the end cap, toward the block connector, and attached to the end cap.

BRIEF DESCRIPTION OF THE DRAWINGS

Embodiments of the invention are described with reference to the following drawings which are modified standard engineering drawings. The information contained in the drawings is hereby incorporated into this detailed description of the invention. However, changes could be made to the invention as depicted in the drawings without departing from the scope of the present invention.

DETAILED DESCRIPTION

Figure 1:
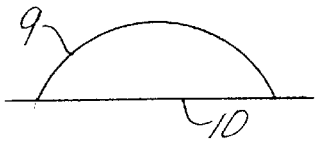
FIG. 1 is a schematic elevational view of a dome shaped reticulated structure utilizing the moment resisting characteristics of the present invention.
Figure 2:
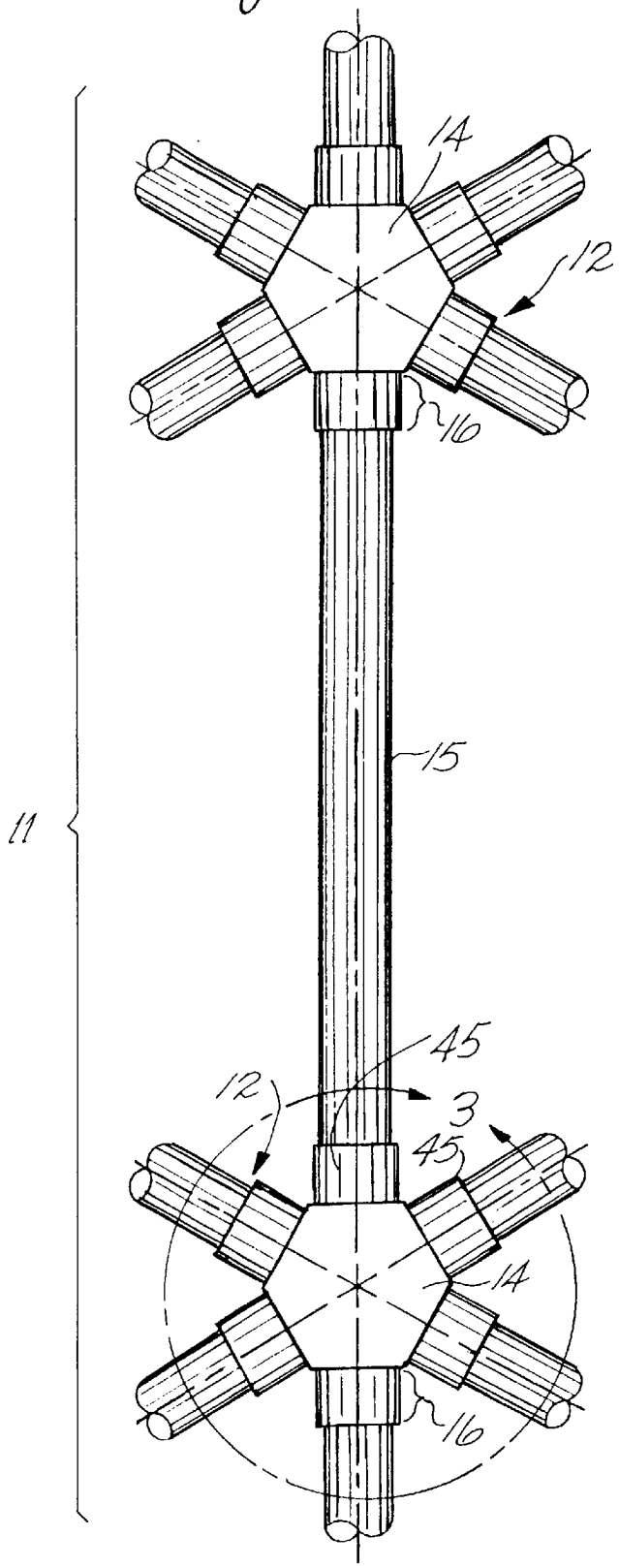
FIG. 2 is a plan view of a portion of an assembled CAJ moment resisting connection system.
Figure 3:
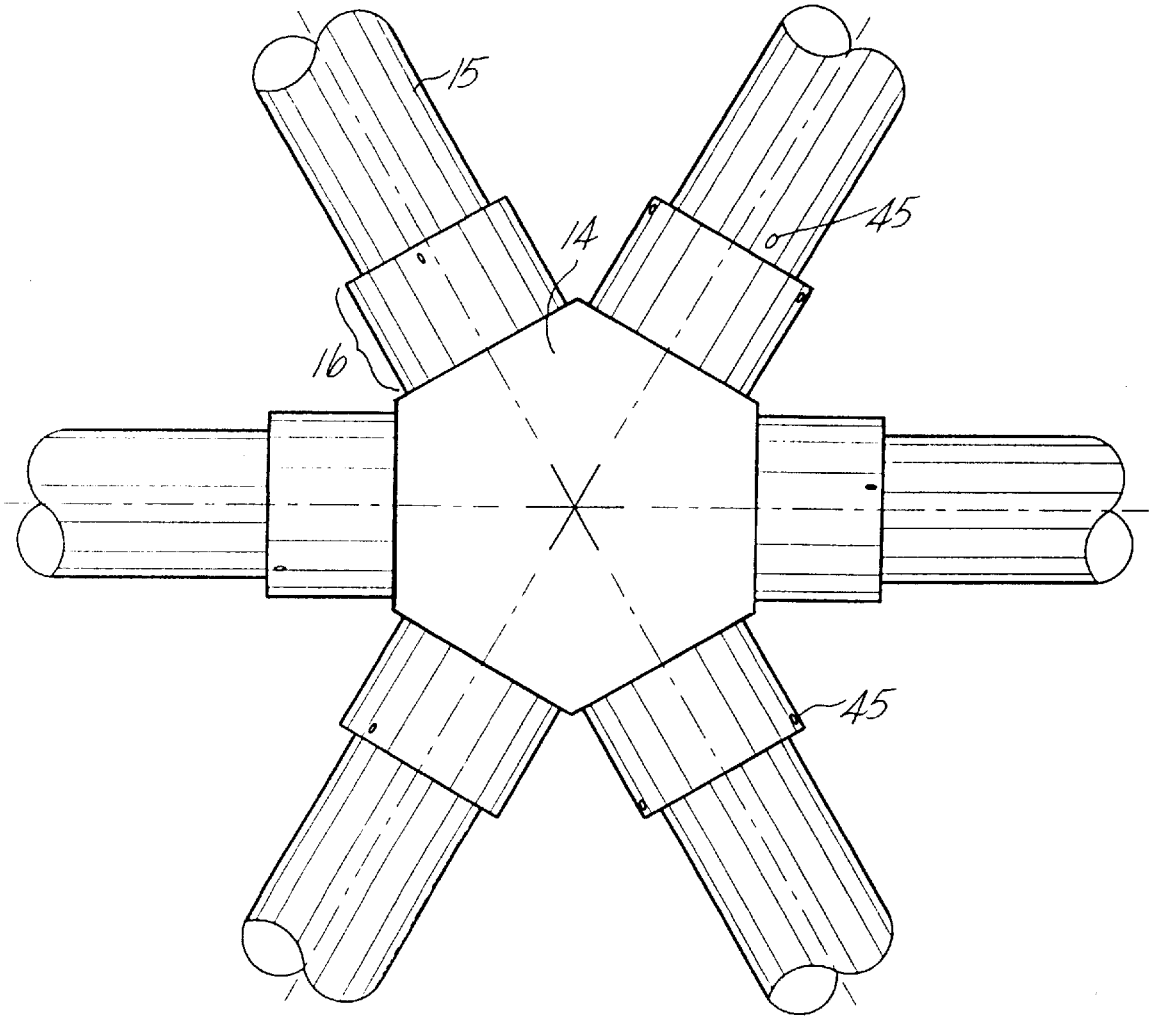
FIG. 3 is a plan view of a single block connector and a typical series of CAJ System connections taken from within circle 3 of FIG. 2.

A dome shaped reticulated structure 9 resting on foundation 10 as shown in FIG. 1 utilizes at least one CAJ System 11 as depicted in FIGS. 2 and 3. A preferred embodiment of an assembled CAJ design system 11 comprises a plurality of CAJ design system connections 12. Each connection 12 is comprised of a three dimensional block connector 14, framing member 15, and member-block connector attachment assembly 16. In practice, the framing member 15 is attached to the block connector 14, which functions as a node element, through the memberblock connector attachment assembly 16.

Figure 4:
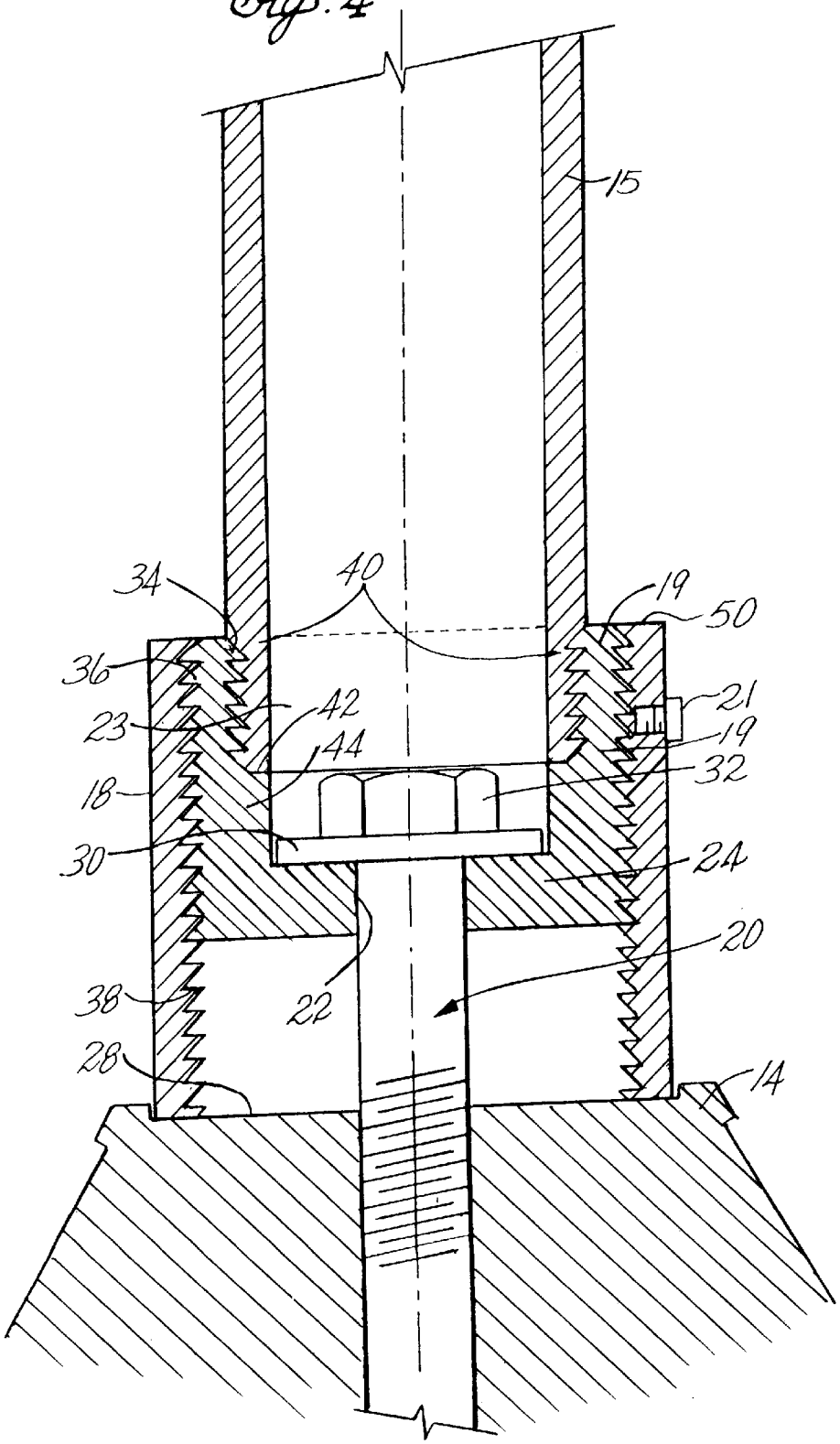
FIG. 4 is a cross-sectional view of a connection shown in FIG. 2, having an externally threaded framing member connection, of the CAJ System connection.
Figure 5:
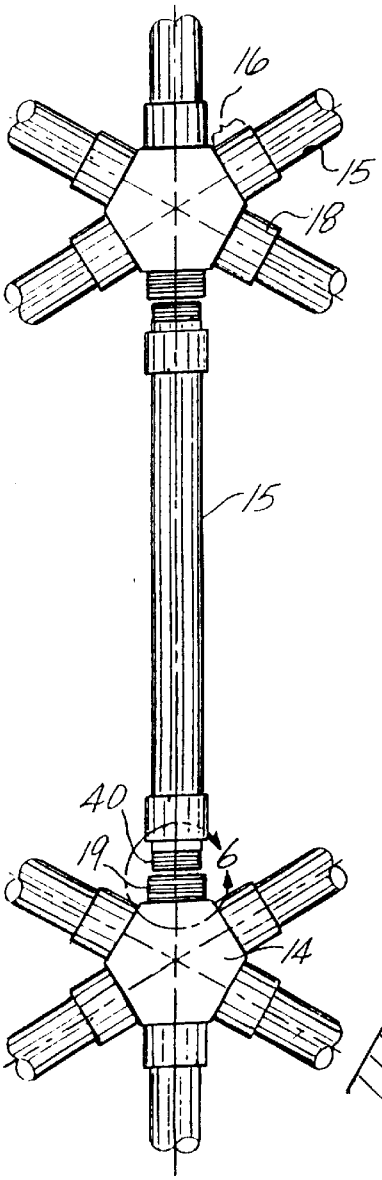
FIG. 5 is a plan view of the CAJ System of FIG. 2 prior to assembly.
Figure 6:
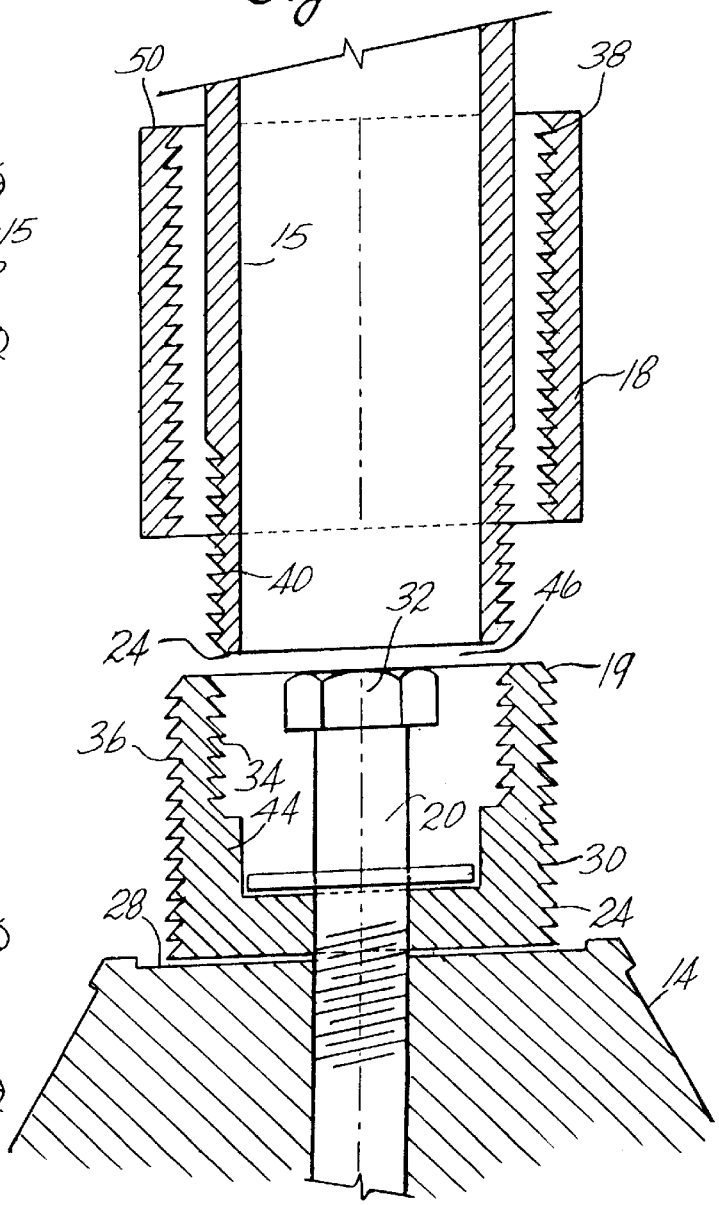
FIG. 6 is a partial cross-sectional view taken from within circle 6 of FIG. 5.
Figure 7:
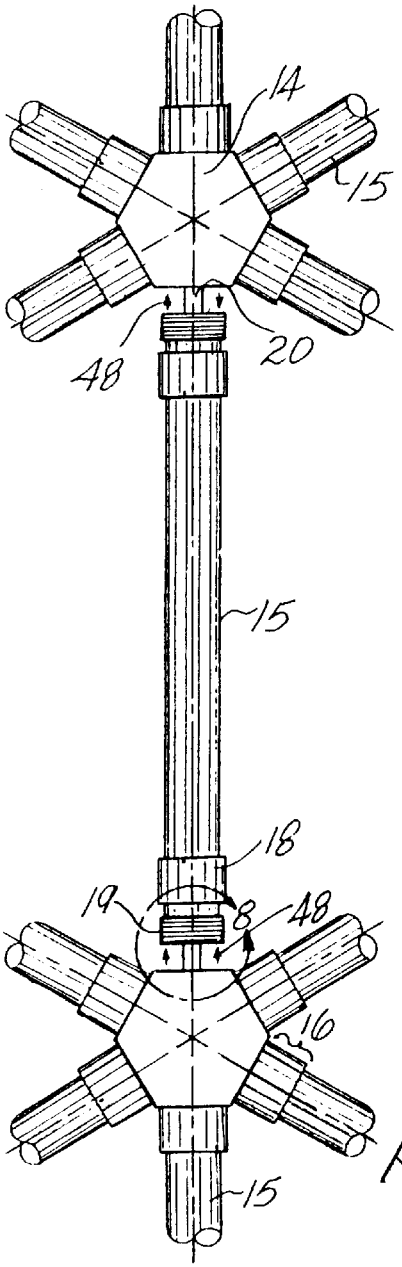
FIG. 7 is a plan view of the CAJ System of FIG. 2 partially assembled.
Figure 8:
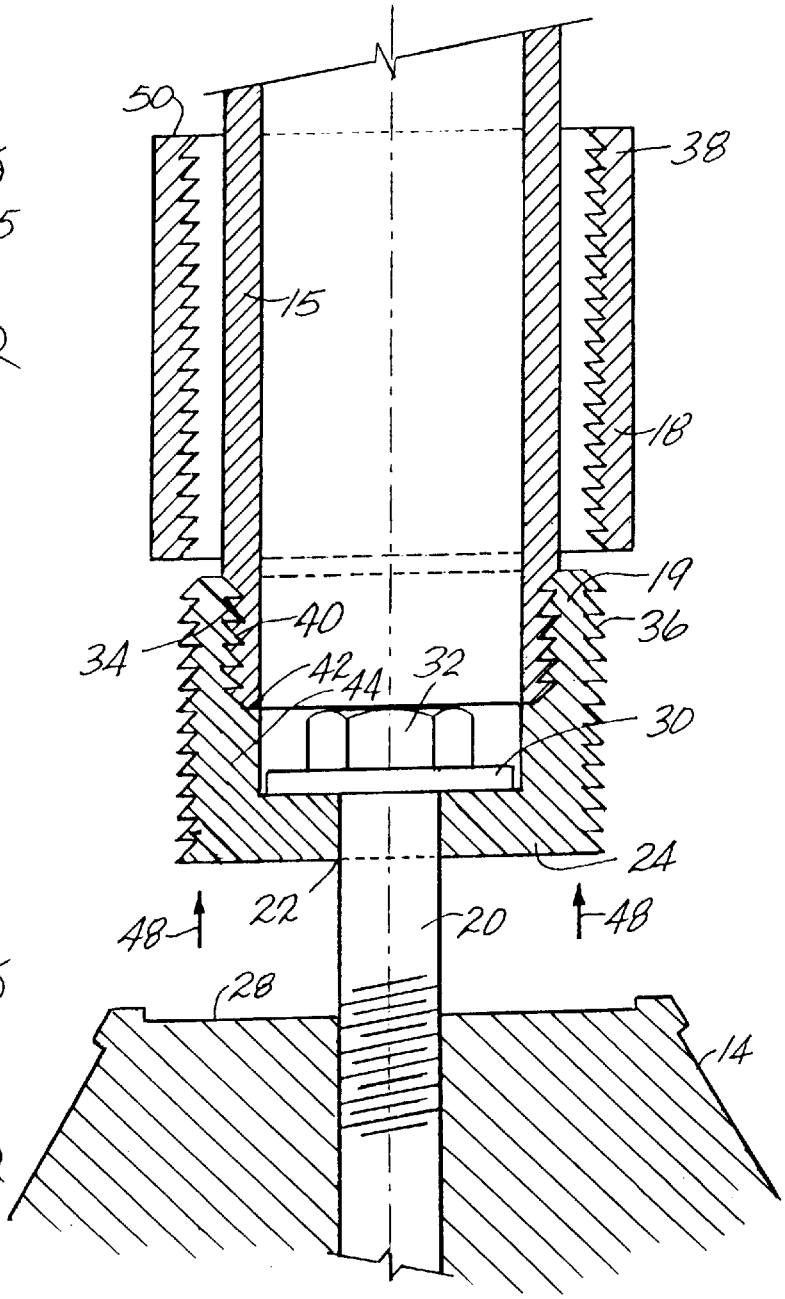
FIG. 8 is a partial cross-sectional view taken from within circle 8 of FIG. 7.

Referring to FIG. 4, the member-block connector attachment assembly 16 used in the CAJ System employs a compression sleeve 18 through which the framing member 15 is inserted, an end cap 19 which is capable of connecting to both the framing member 15 and the sleeve 18, and an attachment mechanism, generally designated 20, that secures the end cap 19 to the block connector 14. The end cap and sleeve comprise inner and outer connection moieties, respectively, and the attachment mechanism operates as a tension carrier while the sleeve operates as a compression carrier. The end cap is free to slide on the attachment mechanism, and the framing member, end cap, sleeve, and attachment mechanism have a co-axial configuration.

This embodiment has an outer diameter (O.D.) or externally threaded framing member connection. The end cap 19 is a cylindrical cup shaped member with an opening 22 in its bottom end to receive the attachment means 20 which is preferably a tension bolt. The end cap 19 has an internal cavity 23 accessible through the open top of the end cap. The tension bolt is inserted through the cap internal cavity and the opening 22 in the base of the end cap and is threaded into the block connector to a predetermined depth. Thus, the end cap is limited in how far it can move away from the block connector. Tension buttress threads 34 are on the internal cap surface, and compression buttress threads 36 are on the external cap surface. Both sets of threads extend perpendicular to the connection surface of the block connector.

The end cap can be connected to the block connector in the field or at the factory. It is preferable to attach the end cap at the factory because doing so completely eliminates the use of bolts at the construction site, thereby decreasing the time spent at the construction site. Additionally, the tension bolt could be set at a predetermined depth in the block connector in order to simplify dimensional control of the structure.

The base 24 of the end cap runs parallel to the block connector and is capable of resting flush against a spot faced connection surface 28 on the block connector, or of moving along the tension bolt until it contacts a washer 30 disposed on the tension bolt between the bolt head 32 and the base of the end cap. Thus, there is a limit to how far away the end cap can move from the node element, i.e., the block connector. The connection surface 28 comprises a circular recess into the block connector. The diameter of the recess is sized to snugly receive the outer diameter of the compression sleeve. Thus, shear forces are borne by the connection between the block connector recess and the compression sleeve.

The cylindrical framing member 15 which has proximal and distal ends relative to the block connector is attachable to the end cap internal cavity surface. The framing member has buttress threads 40 located on the external surface of at least one of its ends forming an end connection portion. The threads 40 are complimentary to the tension buttress threads 34 on the internal surface of the end cap. Thus, tensile load is borne by the tension bolt, end cap, and framing member. The tension path is from the block connector to the tension bolt, from the tension bolt to the end cap via the washer compressed between them, and from the end cap to the framing member through the threaded connection 34, 40 between them. The tension buttress threads provide relatively little support in compression. Further, because the end cap is free to slide over the bolt toward the block connector, the bolt cannot be loaded in compression.

Therefore, the hollow, cylindrical compression sleeve 18 is provided. The sleeve has sufficient diameter to encompass both the cylindrical framing member and the end cap. The sleeve acts as a length adjusting member in that it allows the functional length of the framing member to be larger than its actual length, and it is slidable relative to the framing member. The internal cavity of the compression sleeve is accessible from both the open top and open bottom of the sleeve. On its internal surface, the sleeve 18 has buttress threads 38 complimentary to the compression buttress threads 36 on the external surface of the end cap. The end cap acts to secure the sleeve between the framing member and block connector. Thus, compressive load is borne by the sleeve, end cap, and framing member. The compression path is from the block connector to the sleeve, from the sleeve to the end cap via the threaded connection between them, and from the end cap to the framing member via the landing of the end 42 of the framing member on a circumferential shoulder 44 of the end cap. Thus, the shoulder forms a thrust seat for application of compression.

The compression buttress threads are reinforced to prevent the end cap from being forced into the sleeve. The abutting connection between the sleeve and the block connector provides no support for tensile loads. However, the entire connection assembly provides a complete joint with tensile, compressive, and shear forces being borne by the elements best able to bear the respective forces, and because the framing member attaches to the block connector with a connection assembly that does not have a reduced diameter, a moment resisting joint is created.

Referring to FIGS. 5 through 8, the O.D. framing member embodiment of the CAJ design system is assembled by threading the tension bolts 20, fitted with the washers 30, through the bases 24 of the end caps 19, and into the block connectors 14, movably attaching the end caps to the block connectors. The cylindrical framing member 15 is then inserted through the cylindrical sleeves, and the framing member is positioned such that the threads located on the framing member's external end surfaces are aligned with the end caps between the two block connectors. Thus, the framing member, sleeves, end caps, and tension bolts are coaxial. The length of the framing member leaves a gap 46 between the framing member and the tension bolt at each end, so that the framing member is easily inserted between the two block connectors.

The remainder of the assembly will be described with reference to only one end of the framing member. With the washer and a portion of the tension bolt in the internal cavity of the end cap, the end cap is shifted toward the framing member as illustrated by arrows 48 in FIG. 8. The buttress threads on the internal surface of the end cap are threaded onto the buttress threads of the external surface of the cylindrical framing member and tightened until the end 42 of the framing member snugly contacts the shoulder 44 of the end cap, at which point the washer 30 should be snugly engaged between bolt head 32 and the surface at the base end of end cap 19 which forms the bottom of cavity 23. In the system shown in FIGS. 2–8, as well as in the system shown in FIG. 9, the portion of the shaft of each tension bolt 20 adjacent its head 32 can be unthreaded and preferably non-round, e.g., hexagonal to enable the bolt to be engaged and rotated by a wrench. In this way, a tension bolt can be initially positioned in the block connector with the bolt head sufficiently far from the block connector to assure that the end cap can move along the bolt into the desired abutment of its shoulder 42 with the end of framing member 15. Any clearance or looseness which then exists between the bolt head and washer 30, on the one hand, and the base of the end cap recess, on the other hand, can be eliminated by wrenching the bolt into the block connector to establish the desired snug engagement of washer 30 between the bolt head and the end cap and to pretension the bolt if that condition is desired.

The compression sleeve 18 is then moved along the framing member toward the end cap, and the buttress threads on the internal surface of the cylindrical sleeve are threaded on to the buttress threads of the external surface of the end cap and tightened to cause the lower end of the compression sleeve 18 to snugly abut surface 28 on the block connector. Once the joint is assembled, the joint can be secured with a set screw 21 which impinges on the threads of the end cap.

The length of the framing member is determined by the design constraints of the structure. However, once the length is chosen it must be manufactured with low tolerances to assure a proper fit with the end cap and proper alignment of the sleeves distal edge 50 with the end cap.

Spanner wrenches can be used to turn the end cap into its threaded conection to the framing member and to turn the compression sleeve into its connection to the end cap and its abutment with the block connector surface 28. A spanner wrench has an elongated handle with a curved top portion and a projection extending toward the handle from the end of the top portion. The sleeves, end caps, and framing members, depending on the embodiment, have openings 45 (FIG. 2) to receive the projection of the spanner wrench. In a properly assembled connection 12, the level of snugness with which end cap shoulder 44 engages the end 42 of the framing members, with which washer 30 is held between bolt head 32 and end cap 19, and with which the compression sleeve abuts surfaces 28 is sufficient that those sets of elements remain in contact with each other throughout the range of thermal expansions and contractions the connection components are expected to experience. The block connector 14 is shown to be hexagonal in shape but, in practice, is not limited to that configuration, and further can be 3 (three) dimensional for use in space frame and other similar structures. Block connectors should be designed to sufficiently accommodate the plurality of frame members which may need to be attached to them. Beyond this design consideration, the block connector itself may be of any size, shape or configuration. Without the physical requirement of a spherical node, the CAJ System can be more adaptable to space frame applications and more efficient to fabricate. Similarly, the framing members 15 preferably are linear and cylindrical in shape, but in practicing the CAJ design system, the framing members are not rotated. Therefore, the framing members are not limited to that configuration. The framing members may be of any size, shape or configuration, including curved or twisted tubes and tubes with prismatic or octagonal crosssections, provided the ends of the framing member are capable of attaching to a cylindrical end cap. The unique member-block connector attachment assemblies attach the framing members to block connectors, without manipulation or rotation of the framing members, thus permitting the use of non-cylindrical, non-linear, or even intertwined framing members.

Because the CAJ System is comprised of elements connected together at rigid (stiff) joints, the CAJ System provides numerous benefits. The elimination of tapered connection points permits transfer of moment and eliminates the need to employ a hypothetical hinge when modeling a proposed reticulated structure, thereby simplifying structural design. The CAJ System's moment resisting ability also permits the CAJ System to be employed in ductile frames as well as triangulated frames. Further, the framing members can be treated like beams. Thus, loads can be applied to the framing members, and therefore, loud speakers, lights, and other equipment can be attached where it is most convenient whether to a node or to a framing member.

Since the CAJ System uses framing members directly connected to block connectors in a fixated, moment resisting manner, the CAJ System can take greater advantage of the compression bearing capabilities of cylindrical framing members and, consequently, increase the system's bearing capacity up to two times standard tube and ball node systems. As a result, the CAJ System can employ tubes with either half the diameter or twice the length and yet still sustain the same load bearing capacity as a similarly sized and loaded tube and ball node system.

By eliminating the need to weld framing members to connection assemblies, the CAJ System also permits significant latitude in the type of materials employed and in the field erection of structures. A variety of weld-sensitive materials with desirable strength, cost, aesthetic, and other characteristics may be used in the CAJ System without fear of causing damage to the materials by welding and thereby reducing their stress bearing capacity. The elimination of welding also permits rapid assembly, cuts costs, reduces manufacturing steps, material use, and enables greater flexibility in the field erection of structures. In particular, because the CAJ System provides built-in clearance for framing members, it is no longer problematic to insert a framing member between two fixed block connectors. Unlike some tube and ball node systems, the CAJ System permits the easy installation or replacement of a framing member between two fixed nodes. This is possible because the sleeves make up some of the length between the block connectors, and the sleeves completely overlap the framing members before connection.

Almost any solid material may be employed in the CAJ design system. Specifically, because no welding is required in the assembly of the CAJ design system, materials with weld-sensitive strength characteristics, such as aluminum or composites, may be used without concern over a reduction in material strength, ductility, or other properties.

Figure 9:
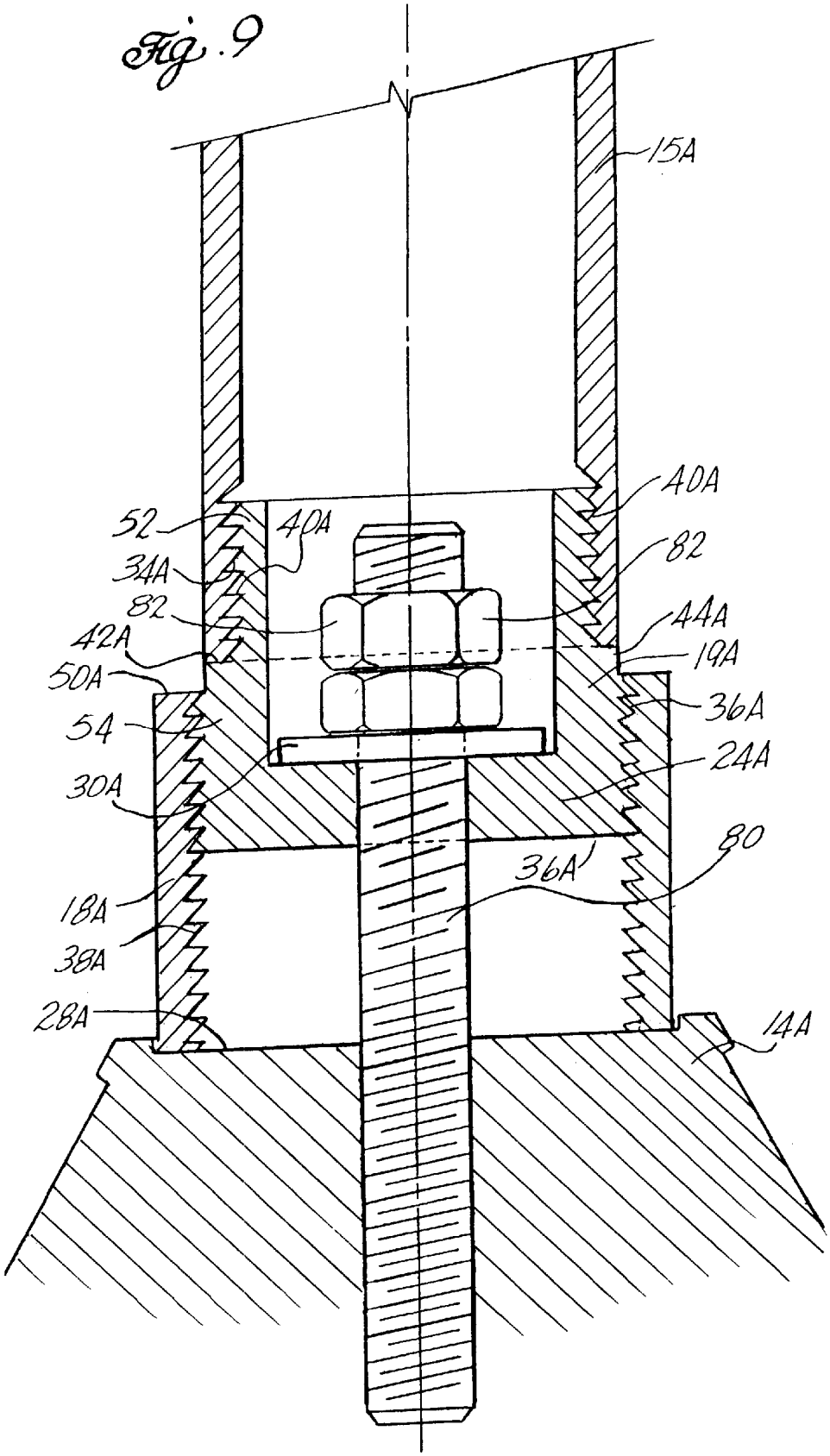
FIG. 9 is a cross-sectional view of an alternate embodiment of the CAJ System connection, having an internally threaded framing member connection.

A second embodiment of the CAJ design system, having an inner diameter (internally threaded) framing member connection, is depicted in FIG. 9 wherein elements similar to those already described have been given the corresponding reference numeral with the distinguishing suffix A added thereto. The end cap 19A is attached to a block connector 14A via an all thread stud 80, two jam nuts 82, and a washer 30A. This arrangement allows field adjustment of the end caps' maximum distance away from the block connector to obtain the desired secure fit for the framing member between two block connectors.

The end cap is cylindrically shaped with an internal cavity accessible through the open top of the end cap and an internal diameter of preferably constant magnitude throughout the cavity height. The external circumference of the end cap varies in magnitude, with the top portion 52 of the end cap having a smaller circumference than the bottom portion 54 of the end cap. The top portion has external tension buttress threads 34A to threadably engage internal buttress threads 40A of the framing member 15A, and the bottom portion has external compression buttress threads 36A to threadably engage internal buttress threads 38A on the compression sleeve 18A. The framing member, which is capable of attaching to the externally threaded top portion 52 of the end cap, has the buttress threads 40A located on the internal surface of its ends. The base of the end cap again runs parallel to the block connector connection surface 28A and is capable of resting flush against the block connector connection surface. The tension stud extends through the base of the end cap and into the internal volume of the block connector. The jam nuts 82 and end cap base 24A are physically separated by a washer 30A. The tension stud is threaded into the block connector.

The hollow cylindrical sleeve 18A is of sufficient diameter to encompass both the cylindrical framing member 15A and end cap 19A. The sleeve acts as a length adjusting member and is slidable relative to the framing member. The internal cavity of the cylindrical sleeve is accessible from both the open top and bottom of the sleeve. On the internal cavity surface of the sleeve are the buttress threads 38A complimentary to the buttress threads 36A on the external surface of the bottom portion of the end cap. The end cap acts to secure the sleeve between the framing member and the block connector. By doing so, the sleeve acts between the end cap and the block connector 14A to resist moments applied from or to the framing members.

This internally threaded framing member embodiment of the CAJ design system is assembled, similarly to the previous embodiment, by threading the tension rod, fitted with a washer and lock nut, through the base of the end cap, and into the block connector, movably attaching the end cap to the block connector. The framing member is then inserted through the cylindrical sleeve and the framing member is positioned such that the threads located on the framing member's internal end surface are aligned with the end cap. With the washer and a portion of the tension stud in the internal cavity of the end cap, the end cap is shifted toward the framing member. The buttress threads on the external surface of the top portion of the end cap are threaded onto the buttress threads of the internal surface of the cylindrical framing member and tightened using a spanner wrench, e.g. The lower end 44A of the framing member is snugged against an external shoulder 42A on the end cap as washer 30A is snugged between the end cap base and the jamb nuts. The buttress threads on the internal surface of the cylindrical sleeve are then threaded on to the buttress threads of the external surface of the bottom portion of the end cap and tightened with a spanner wrench, e.g., to snug the lower end of the sleeve against to block connector surface 28A.

The complimentary buttress threads used to attach the framing member to the end cap and to attach the sleeve to the end cap can alternate in thread direction to provide for greater ease in assembly. By alternating thread direction, one can, for example, thread the end cap to the framing member and then subsequently thread the sleeve to the end cap without reversing the initial threaded connection between the end cap and framing member. The thread directions may be either clockwise or counter clockwise, provided they alternate between the two attachment points, end cap to framing member, and end cap to sleeve. Furthermore, while this embodiment employs complimentary buttress threads as the preferred means of attaching the framing member to the end cap and of attaching the sleeve to the end cap, other attachment means can be used in the CAJ System including welding though it is disfavored.

Figure 10:
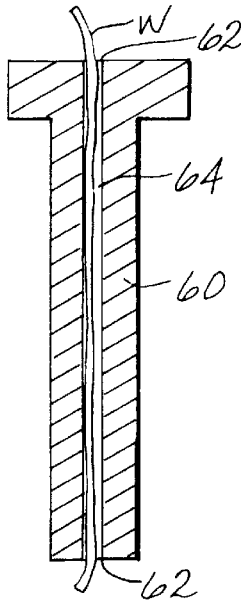
FIG. 10 is a schematic cross-sectional view of a hollow tension bolt.
Figure 11:
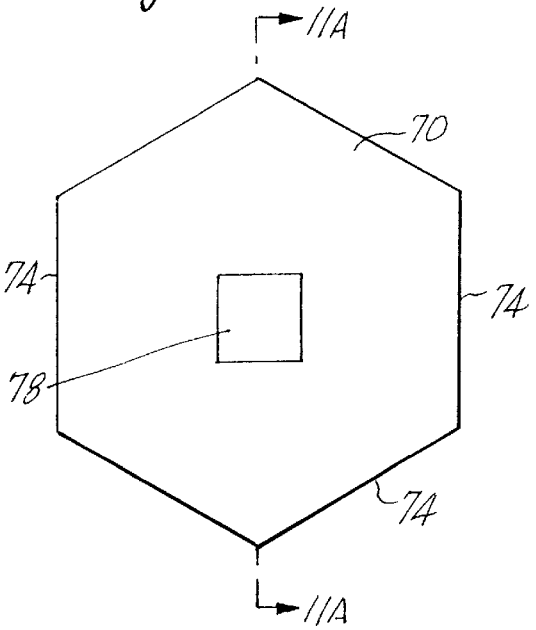
FIG. 11 is a schematic elevational view of a hollow block connector.
Figure 11A:
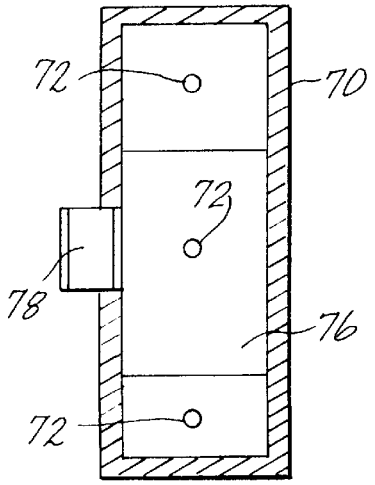
FIG. 11A is a schematic cross-sectional view of the hollow block connector of FIG. 11.

In an alternate embodiment, a tension bolt 60 is axially hollow and has openings 62 to permit wires W to be run through the central passage 64 of the bolt, as depicted in FIG. 10. Additionally, as stated previously, the shape and configuration of the block connector is not limited to the shape depicted in this embodiment. The block connector can be of any shape which would permit the framing member-block connector assembly 16 to securely position the framing member 5 against the block connector 14. In an alternate embodiment shown in FIGS. 11 and 11A, the block connector 70 is also hollow with openings 72 on each connection surface 74 leading to a central cavity 76 in order to accommodate the use of wiring in a reticulated structure. The block connector is further provided with a hatch 78 to allow access for running wires.

While the framing member has been depicted as having an internal cavity, it could range in filled volume and is not required to be substantially hollow. The degree of filled volume in the framing member is dependent upon the required load bearing capacity and other design considerations.

Although the CAJ design system embodiments depicted generally use a tension bolt to attach the end cap with the block connector, it is important to note that other attachment means can be employed in the CAJ design system such as the all thread stud.

Figure 12:
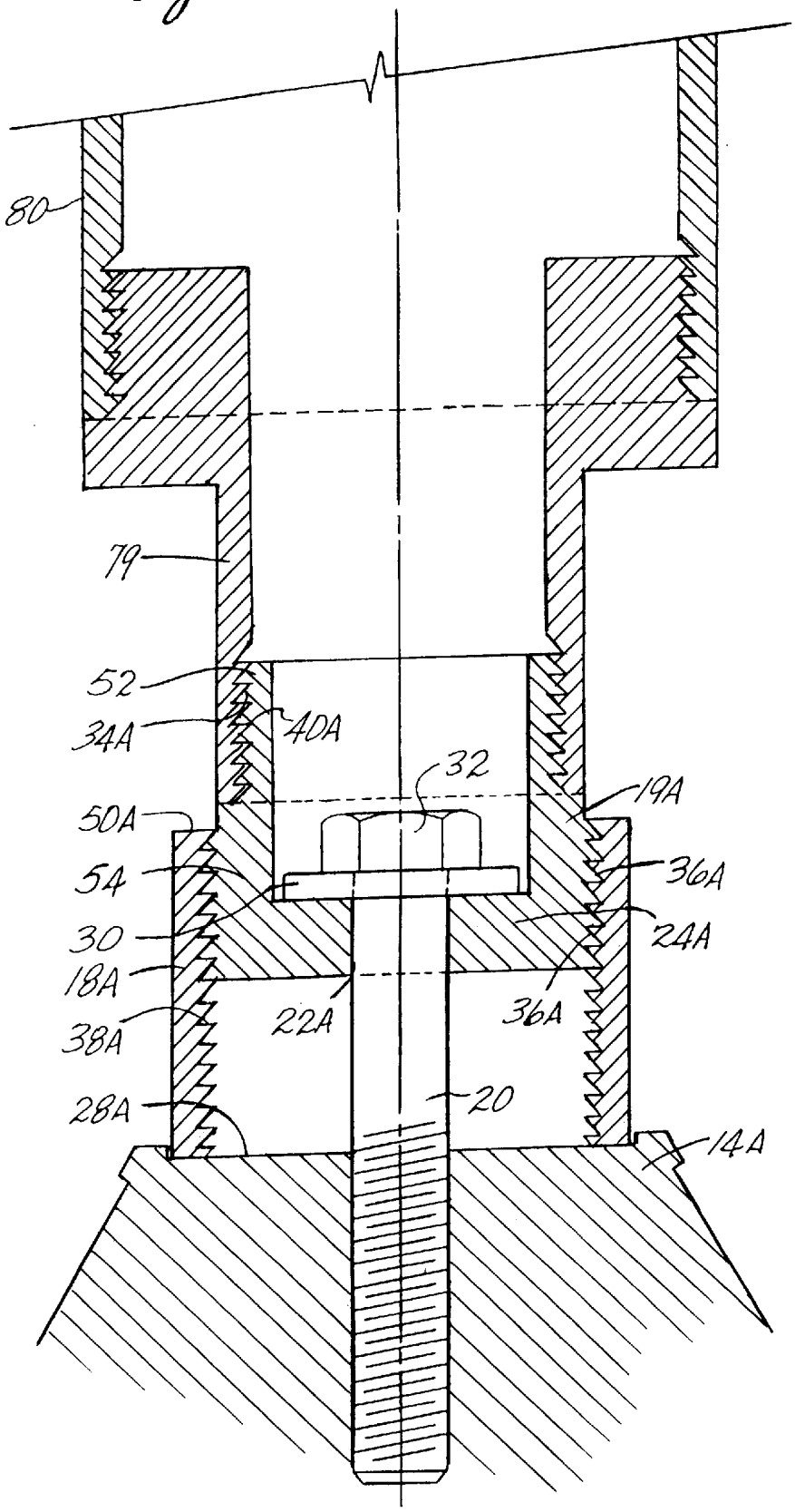
FIG. 12 is a schematic cross-sectional view similar to FIG. 9 except a larger diameter framing member is depicted.

Further, the CAJ System can be provided with threaded bushings which operate to join pipes of different diameters as depicted in FIG. 12. The bushings 79 allow tubular framing members of different sizes 80 to be connected to the same block connector.

Additionally, inherent with the design flexibility of the block connector 14A, the spot-faced recesses 28A, compression sleeves 18A, the end cap 24A, the system can be sized to accept tubular framing members 80 of various diameters at the same joint, without the use of the threaded bushing 79.

I claim:

1. An improved connection for a node element in a reticulated structure comprising:

a framing member;

an inner and an outer connector moiety;

a tension carrier affixed to the node element and extending slidably through the inner moiety, the carrier and the inner moiety being cooperatively configured for defining a limit of motion of the inner moiety along the carrier from the node element;

a first connection between the inner moiety and the framing member defined for withstanding tension in the framing member, the connection between the inner moiety and the framing member also defining a thrust seat for application of compression in the framing member to the inner moiety; and a second connection between the inner and outer moieties defined for accepting and carrying to the node element compressive load in the framing member as applied to the outer moiety via the inner moiety, the tension carrier and the connector moieties being so dimensioned that in the completed connection the framing member engages the thrust seat of the inner moiety and the outer moiety compressively abuts the node element when the inner moiety is essentially at its motion limit relative to the node element.

2. The improved connection according to claim 1 wherein the inner moiety has internal threads and external threads.

3. The improved connection according to claim 2 wherein the outer moiety comprises internal threads for engagement with the external threads of the inner moiety.

4. The improved connection according to claim 2 wherein the framing member comprises external threads on an end of the member for engagement with the internal threads of the inner moiety.

5. The improved connection according to claim 2 wherein the internal threads of the inner moiety comprises tension buttress threads.

6. The improved connection according to claim 2 wherein the external threads of the inner moiety comprises compression buttress threads.

7. The improved connection according to claim 1 wherein the inner moiety comprises first external threads and second external threads.

8. The improved connection according to claim 7 wherein the framing member comprises internal threads on an end of the member for engagement with the second external threads of the inner moiety.

9. The improved connection according to claim 7 wherein the internal threads of the outer moiety and the first external threads of the inner moiety comprises compression buttress threads.

10. The improved connection according to claim 1 wherein the inner moiety comprises an end cap having a top end, a bottom end, and an internal cavity, wherein the tension connector extends through the bottom end of the end cap, and wherein the framing member extends through the top end of the end cap into the internal cavity.

11. The improved connection according to claim 10 wherein the thrust seat comprises a shoulder in the inner cavity of the inner moiety, and wherein an end of the framing member abuts the shoulder for application of compression in the framing member to the inner moiety.

12. The improved connection according to claim 1 wherein the outer moiety is slidable relative to the framing member.

13. The improved connection according to claim 1 wherein the outer moiety is extendable beyond the framing member for abutment with the node element.

14. The improved connection according to claim 1 wherein the outer moiety comprises a compression sleeve having a diameter sufficient to encompass the inner moiety and the framing member.

15. The improved connection according to claim 1 wherein the tension carrier comprises a tension bolt.

16. The improved connection according to claim 15 wherein the tension bolt comprises a head, the head defining the limit of motion of the inner moiety along the tension carrier from the node element.

17. The improved connection according to claim 1 wherein the tension carrier is axially hollow.

18. The improved connection according to claim 1 wherein the tension carrier defines a clearance between the framing member and the node element when the framing element is connected to the node element.

19. The improved connection according to claim 1 wherein the tension carrier comprises a stud and a pair of nuts configured to allow adjustment of the limit of motion of the inner moiety along the carrier from the node element.

20. The improved connection according to claim 1 wherein the framing member has a length, and has a substantially uniform cross section along its entire length.

21. The improved connection according to claim 1 wherein the framing member is cylindrical.

22. The improved connection according to claim 1 further comprising a bushing connecting the inner moiety to the framing member.

23. The improved connection according to claim 1 wherein the inner moiety, outer moiety, framing member and tension carrier are arranged in a coaxial relation.

24. A method for connecting a framing member to a node element in a reticulated structure, the framing member having an end connection portion, the method including:

(a) making captive to the node element the inner one of inner and outer connector moieties, while enabling the inner moiety to move along a path away from the node element into contact with a stop, (b) disposing the inner moiety away from the stop and aligning the framing member connection portion with the inner moiety, (c) moving the inner moiety from the node element toward the stop, (d) establishing between the connection portion and the inner moiety a connection which places the inner moiety essentially at the stop, which resists pulling of the inner moiety away from the connection portion, and produces face-to-face abutment of the connection portion with the inner moiety substantially in a plane substantially normal to said path, (e) disposing the outer moiety about the inner moiety and establishing between them a connection which places the outer moiety in compressive abutment with the node element and which resists motion of the inner moiety toward the node element.

25. The method according to claim 24 wherein the making captive step comprises inserting a tension carrier through the inner moiety and coupling the tension carrier to the node element.

26. The method according to claim 24 wherein the step of establishing a connection between the connection portion of the framing member and the inner moiety comprises threadably engaging the framing member to the inner moiety.

27. The method according to claim 24 wherein the step of establishing a connection between the outer moiety and the inner moiety comprises threadably engaging the outer moiety to the inner moiety.

* * * * *